US006353718B1

(12) United States Patent
Roxon et al.

(10) Patent No.: US 6,353,718 B1
(45) Date of Patent: Mar. 5, 2002

(54) XEROGRAPHIC FUSING APPARATUS WITH MULTIPLE HEATING ELEMENTS

(75) Inventors: John Roxon, Stevenage; Ian Pitts, Bassingbourn, both of (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/715,817

(22) Filed: Nov. 17, 2000

(51) Int. Cl.[7] ..... G03G 15/20
(52) U.S. Cl. ..... 399/67; 399/336
(58) Field of Search ..... 399/67, 69, 336, 399/337, 330, 331

(56) References Cited

U.S. PATENT DOCUMENTS

| | | | | |
|---|---|---|---|---|
| 4,001,545 | A | 1/1977 | Wada et al. | 219/216 |
| 4,075,455 | A | 2/1978 | Kitamura et al. | 219/216 |
| 4,297,562 | A | 10/1981 | Kamogawa et al. | 219/216 |
| 4,301,359 | A | 11/1981 | Ito et al. | 219/469 |
| 4,309,591 | A | 1/1982 | Kanoto et al. | 219/216 |
| 4,585,325 | A | 4/1986 | Euler | 355/3 FU |
| 4,801,968 | A | 1/1989 | Kogure et al. | 355/3 FU |
| 4,825,242 | A | 4/1989 | Elter | 355/14 FU |
| 5,300,996 | A | 4/1994 | Yokoyama et al. | 355/285 |
| 5,355,203 | A | 10/1994 | Nishikawa et al. | 355/285 |
| 5,497,218 | A | 3/1996 | Amico | 355/208 |
| 5,819,134 | A | 10/1998 | Sato et al. | 399/69 |
| 5,826,152 | A | 10/1998 | Suzuki et al. | 399/330 |
| 5,862,436 | A | 1/1999 | Ishizawa et al. | 399/69 |
| 5,899,599 | A | 5/1999 | Kato | 399/69 |
| 5,904,871 | A | 5/1999 | Sakai et al. | 219/216 |
| 6,008,829 | A | 12/1999 | Wakamiya et al. | 347/156 |
| 6,011,939 | A | 1/2000 | Martin | 399/69 |

FOREIGN PATENT DOCUMENTS

| | | |
|---|---|---|
| EP | A1-0 361 562 | 8/1989 |
| EP | A2-0 962 837 | 12/1999 |

*Primary Examiner*—Fred L Braun
(74) *Attorney, Agent, or Firm*—R. Hutter

(57) ABSTRACT

A fusing apparatus for xerographic printing includes a fuser roll with two parallel lamps, or heating elements, therein. Each lamp defines a relatively hot end and a relatively cold end when electrical power is applied. The two lamps are disposed so that a hot end of one lamp is adjacent to the cold end of the other lamp. At power-up, power is applied to each lamp in a stair-step fashion, in which incremental increases in applied power for each lamp are staggered in time. Also during power-up, the lamps are connected in series, but the series connection is removed for a running condition. These features contribute to desirable anti-flicker effects of the whole apparatus.

8 Claims, 4 Drawing Sheets

XEROGRAPHIC FUSING APPARATUS WITH MULTIPLE HEATING ELEMENTS

FIELD OF THE INVENTION

The present invention relates to a fusing apparatus, as used in electrostatographic printing, such as xerographic printing or copying, and methods of operating thereof.

BACKGROUND OF THE INVENTION

In electrostatographic printing, commonly known as xerographic or printing or copying, an important process step is known as "fusing." In the fusing step of the xerographic process, dry marking material, such as toner, which has been placed in imagewise fashion on an imaging substrate, such as a sheet of paper, is subjected to heat and/or pressure in order to melt or otherwise fuse the toner permanently on the substrate. In this way, durable, non-smudging images are rendered on the substrates.

Currently, the most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image.

In more sophisticated designs of a fusing apparatus, provision can be made to take into account the fact that sheets of different sizes may be passed through the fusing apparatus, ranging from postcard-sized sheets to sheets which extend the full length of the rolls. Further, it is known to control the heating element or elements inside the fuser roll to take into account the fact that a sheet of a particular size is being fed through the nip. When a relatively large sheet is passed through the nip, it is desirable to have an even distribution of heat along the length of the fuser roll, while when a smaller sheet is passed, it is desirable to radiate heat only along the portion of the fuser roll corresponding to the sheet, so that the system as a whole does not overheat.

Another design consideration which has recently become important in the office equipment industry is the avoidance of "flicker" with regard to a power system associated with the printing apparatus. "Anti-flicker" mandates, which basically require that the alternating current consumption of the machine as a whole does not affect the behavior of other equipment, such as fluorescent lighting, within the same building, are of particular concern in Europe and developing countries.

The present invention is directed toward a particularly advantageous design of a fusing apparatus.

DESCRIPTION OF THE PRIOR ART

U.S. Pat. No. 4,001,545 discloses a fusing apparatus in which multiple heating elements, external to the fuser roll, apply heat energy to different portions of the length of the fuser roll.

U.S. Pat. No. 4,075,455 discloses a fuser plate in which the heating elements are more densely distributed toward the ends of the fuser plate relative to the middle of the fuser plate.

U.S. Pat. No. 4,297,562 discloses a fusing apparatus in which the surface temperature of the fuser roll is intended to be highest at portions of the roll between the center and both axial end of the roll.

U.S. Pat. No. 4,301,359 discloses a fusing apparatus in which thermal sensors are located symmetrically relative to a midpoint along the length of a fuser roll, in order to take into account a profile of heat distribution along the fuser roll.

U.S. Pat. No. 4,309,591 discloses a fusing apparatus in which the heating elements are controlled to take into account the thermal expansion of at least one roll.

U.S. Pat. No. 4,585,325 discloses, at FIG. 2 thereof, a fuser roll having multiple heating elements therein, a first element providing heat toward the center of the roll, and a second element providing heat mainly toward the ends of the roll.

U.S. Pat. No. 4,801,968 discloses a fuser roll having multiple heating elements therein, one heating element providing heat generally along the entire length of the fuser roll, with the other heating element providing heat primarily toward one end of the fuser roll, such as to accommodate relatively small sheets.

U.S. Pat. No. 4,825,242 discloses a fuser roll in which a first heating element is designed to distribute heat substantially along the entire fuser roll, and a second heating element is designed to provide heat only over a portion of the length of the fuser roll.

U.S. Pat. No. 5,300,996 discloses, at FIG. 5 thereof, a fuser roll which includes, among other features, two parallel heating elements.

U.S. Pat. No. 5,355,203 discloses a fuser roll, at FIG. 3A thereof, in which the heating element has a higher resistance toward the ends of the fuser roll.

U.S. Pat. No. 5,497,218 discloses a fuser roll in which a first heating element distributes heat substantially along the entire fuser roll, and a second heating element provides heat only over a portion of the length of the fuser roll.

U.S. Pat. No. 5,819,134 discloses, at FIG. 3 thereof, a fuser roll in which one heating element radiates heat mainly toward the middle of the fuser roll, while a second heating element radiates heat mainly at the ends of the fuser roll.

U.S. Pat. No. 5,826,152 discloses a fuser roll in which the heating elements are disposed within a hollow cylindrical tube inside the roll. Each heating element is independently controllable.

U.S. Pat. No. 5,862,436 discloses a fusing apparatus in which the fuser roll includes three independently controllable heating elements. Different portions of the heating elements are intended to radiate heat particularly toward specific portions along the length of the fuser roll.

U.S. Pat. No. 5,899,599 discloses a fuser roll in which there are provided two parallel heating elements.

U.S. Pat. No. 6,008,829 discloses, at FIG. 2 thereof, a fuser roll in which one heating element radiates heat mainly toward the middle of the fuser roll, while a second heating element radiates heat mainly at the ends of the fuser roll.

U.S. Pat. No. 5,904,871 discloses, at FIG. 3 thereof, a fuser roll in which one heating element radiates heat mainly toward the middle of the fuser roll, while a second heating element radiates heat mainly at the ends of the fuser roll.

U.S. Pat. No. 6,011,939 discloses, at FIGS. 4–6 thereof, a fuser roll in which one heating element is intended to radiate heat mainly toward the middle of the fuser roll, while a second heating element is intended to distribute heat mainly at the ends of the fuser roll.

European Patent Application A1-0 361 562 discloses a fuser roll in which one heating element is intended to radiate heat along the whole length of the fuser roll, while a second heating element is intended to distribute heat mainly at the ends of the fuser roll.

European Patent Application A2-0 962 837 discloses a fuser roll in which one heating element is intended to radiate heat along the whole length of the fuser roll, while a second heating element is intended to distribute heat mainly at the ends of the fuser roll.

SUMMARY OF THE INVENTION

According to one aspect of the present invention, there is provided a fusing apparatus for use in xerographic printing, comprising a first heating element and a second heating element, each of the first heating element and the second heating element having a relatively hot portion and a relatively cold portion. The first heating element and the second heating element are arranged whereby the relatively hot portion of the first heating element is adjacent the relatively cold portion of the second heating element.

According to another aspect of the present invention, there is provided a method of operating a xerographic fusing apparatus, the apparatus having a first heating element and a second heating element, comprising the steps of incrementally changing an amount of power applied to the first heating element; and incrementally changing an amount of power applied to the second heating element outside of a predetermined time window relative to incrementally changing the amount of power applied to the first heating element.

According to another aspect of the present invention, there is provided a method of operating a xerographic fusing apparatus, the apparatus having a first heating element and a second heating element. When increasing power applied to the first heating element and second heating element, the first heating element and second heating element are caused to be connected in series. When the fusing apparatus is in a running condition, the first heating element and second heating element are caused to be not connected in series.

DETAILED DESCRIPTION OF THE INVENTION

Figure 1:
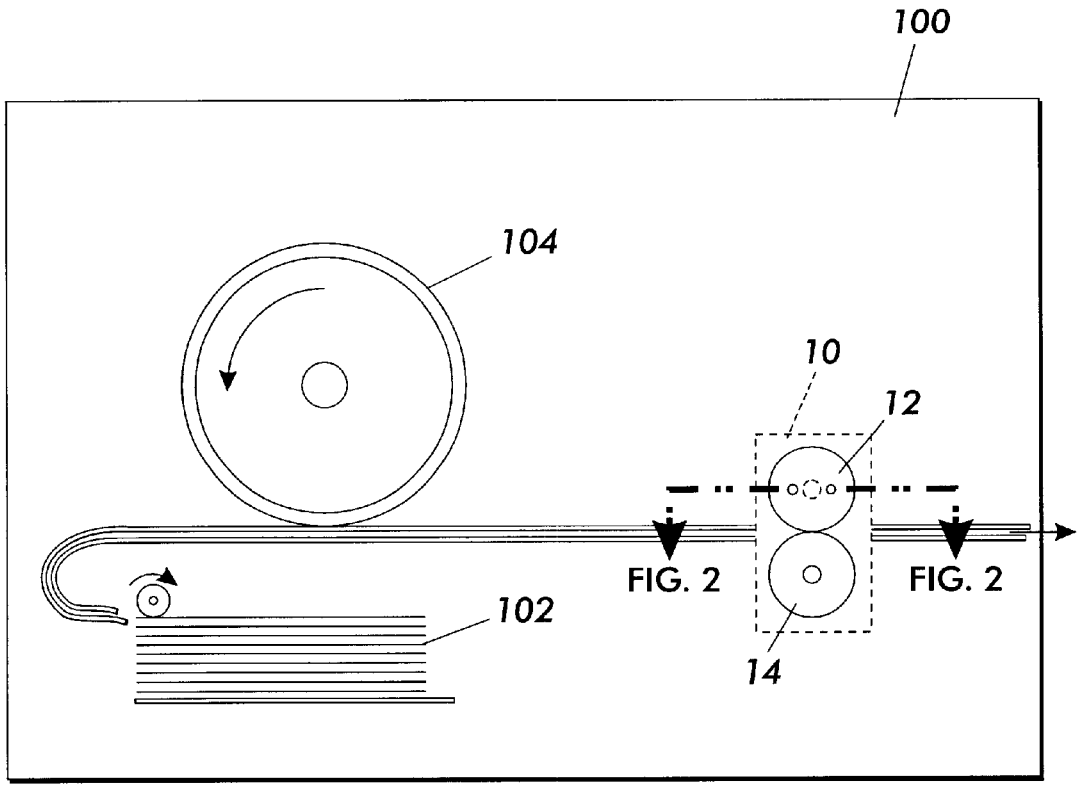
FIG. 1 PRIOR ART
FIG. 1 is a simplified elevational view showing the essential portions of an electrostatographic printer, such as a xerographic printer or copier, relevant to the present invention.

FIG. 1 is a simplified elevational view showing the essential portions of an electrostatographic printer, such as a xerographic printer or copier, relevant to the present invention. A printing apparatus 100, which can be in the form of a digital or analog copier, "laser printer," ionographic printer, or other device, includes mechanisms which draw substrates, such as sheets of paper, from a stack 102 and cause each sheet to obtain a toner image from the surface of a charge receptor 104. Once a particular sheet obtains marking material from charge receptor 104, the sheet is caused to pass through a fusing apparatus such as generally indicated as 10. Depending on a particular design of an apparatus, fusing apparatus 10 may be in the form of a fuser module which can be removed, in modular fashion, from the larger apparatus 100.

A typical design of a fusing apparatus 10 includes a fuser roll 12 and a pressure roll 14. Fuser roll 12 and pressure roll 14 cooperate to exert pressure against each other across a nip formed therebetween. When a sheet passes through the nip, the pressure of the fuser roll against the pressure roll contributes to the fusing of the image on a sheet. Fuser roll 12 further includes means for heating the surface of the roll, so that heat can be supplied to the sheet in addition to the pressure, further enhancing the fusing process. Typically, the fuser roll 12, having the heating means associated therewith, is the roll which contacts the side of the sheet having the image desired to be fused.

Generally, the most common means for generating the desired heat within the fuser roll 12 is one or more heating elements within the interior of fuser roll 12, so that heat generated by the heating elements will cause the outer surface of fuser roll 12 to reach a desired temperature. Various configurations for heating elements have been discussed above with regard to the prior art. Basically, the heating elements can comprise any material which outputs a certain amount of heat in response to the application of electrical power thereto: such heat-generating materials are well known in the art.

Figure 2:
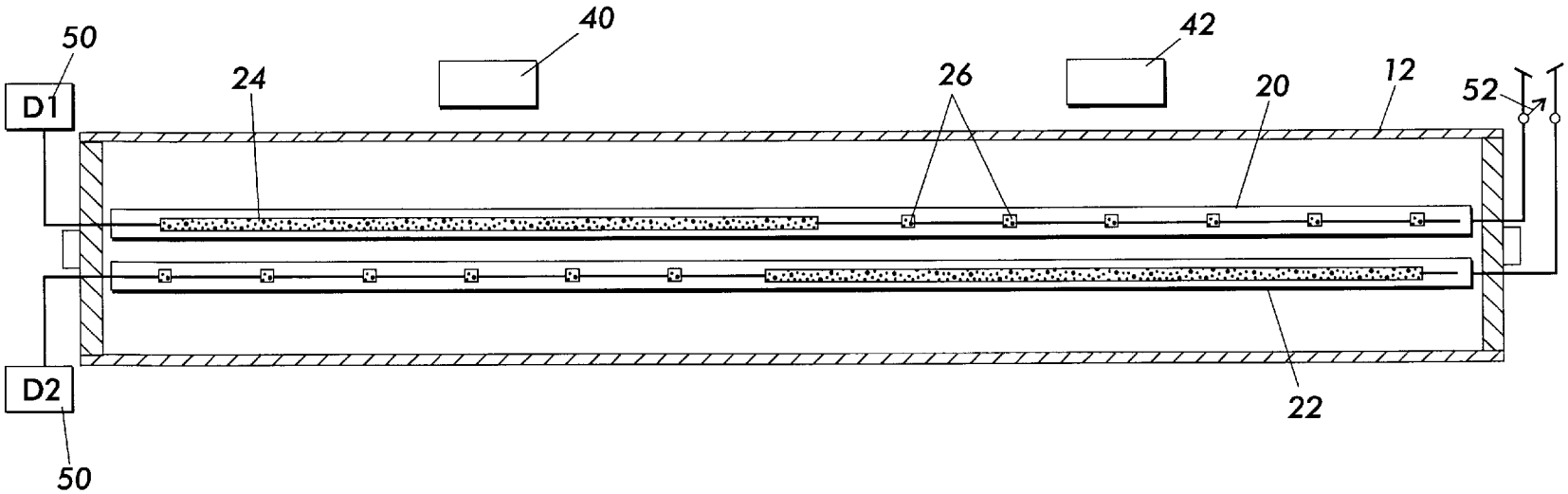
FIG. 2 is a plan sectional view of the fuser roll as viewed through the line marked 2—2 in FIG. 1.

FIG. 2 is a sectional view of the fuser roll 12 as viewed through the line marked 2—2 in FIG. 1. FIG. 2 shows the configuration of heating elements in a fuser roll 12 according to a preferred embodiment of the present invention. As can be seen in the Figure, there is disposed within the interior of fuser roll 12 two "lamps," meaning structures which incorporate heating elements, indicated as 20 and 22. The lamps 20 and 22 are each disposed along the axial length of the fuser roll 12, and as such are disposed to be largely perpendicular to a direction of passage of the sheets passing through the nip of the fusing apparatus 10.

As can be seen in FIG. 2, each lamp, such as 20, includes a specific configuration of heat-producing material, in this particular case, a relatively long major portion of heat-producing material 24, along with a number of smaller portions of heat-producing material, indicated as 26, all of which are connected in series. It will be noted that, within each lamp such as 20 or 22, major portion 24 is disposed toward one particular end of the fuser roll 12, while the relatively smaller portions 26 are disposed toward the opposite end of the fuser roll 12. In a practical embodiment, the heat-producing material substantially comprises tungsten, while the overall structure of the lamp is borosilicate glass: these materials are fairly common in the fuser-lamp context.

With reference to the claims below, it will be apparent that, with the illustrated configuration of heating elements within each lamp 20 or 22, each lamp 20 or 22 can be said to have a relatively hot and a relatively cold end. By this is meant simply that when electrical power is applied to either lamp (a lamp being considered a single heating element), one end of the lamp will largely generate more heat than the other end of the lamp. Other ways to express this can include the fact that the hot end reaches a higher temperature than the cold end, or that the hot end releases more heat per area on the outer surface of the fuser roll 12 than the cold end.

Further according to a preferred embodiment of the present invention, the two lamps 20, 22 are disposed within the fuser roll 12 in parallel with each other, perpendicular to a direction of motion of sheets through the fusing apparatus, and further in a manner such that the relatively hot end of lamp 22 is adjacent the relatively cold end of lamp 20, and vice versa. Lamps 20, 22 should have substantially identical configurations of heat-producing material, and should be oriented in opposite directions, as shown, Further, as can be seen in FIG. 2, the major portion of heat-producing material in the lamp 20 partially overlaps the major portion of heat-producing material in the lamp 22 along the main lengths thereof. It has been found that this configuration of having two identical but oppositely-directed lamps or heating elements contributes positively toward the desired anti-flicker attributes which are required under some standards.

The fuser apparatus according to the present invention is suitable for fusing sheets of a wide range of sizes. If sheets of a size comparable to the entire length of the fuser roll 12 are desired to be processed, than that both lamps 20, 22 can be activated (by means not shown, but as would be apparent in a control system for the printer), yielding a substantially uniform temperature across the entire length of the fuser roll 12. If, however, it is desired to process relatively small, such as postcard-size, sheets, the smaller sheets can be fed through the printing apparatus toward one end of the fuser roll 12, and only that lamp, such as 20, having its major heating element portion such as 24 adjacent to the sheet will be activated.

Figure 3:
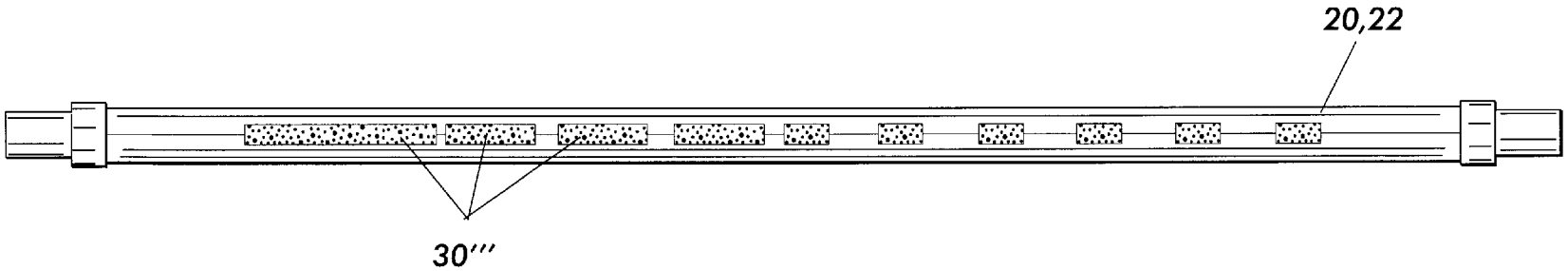
FIG. 3 shows, in isolation, an alternate embodiment of a lamp, usable with the present invention.

FIG. 3 shows, in isolation, an alternate embodiment of a lamp, such as shown as 20 or 22 in FIG. 2. In the FIG. 3 embodiment, a series of relatively short portions of heat-producing material, indicated as 30''', are distributed along the length of the lamp, with individual portions 30''' becoming progressively smaller toward one end. This configuration of heat-producing material may provide a more gradual decrease in heat output along the length of a particular lamp.

Returning to FIG. 2, according to a preferred embodiment, a control system for regulating the temperature of the fuser roll 12 will include temperature sensors, or thermistors, such as indicated at 40 and 42, each of which monitors the local temperature of the surface of the fuser roll 12. According to a preferred embodiment, when the claimed configuration of heating elements is used, a pair of thermistors, such as 40 and 42, are preferably mounted relative to fuser roll 12 symmetrically relative to a midpoint of the fuser roll 12. In this way, each thermistor 40, 42 is directly adjacent equivalent locations along two lamps. This configuration of the thermistors will improve the operation of a larger control system.

Besides the illustrated configuration of portions of heating elements within each lamp as shown, other techniques for establishing a relatively hot end and a relatively cold end of a heating element or lamp will be apparent. For example, there may be provided, within the fuser roll 12, a relatively high-resistance portion of a heating element, in series with a relatively low-resistance portion. Alternately, there may be provided additional heating elements, in parallel with a main set of heating elements within a lamp, achieving the effect of a relatively hot end and a relatively cold end.

In a preferred embodiment of the present invention, the two lamps 20, 22 are powered by separate circuits, each circuit with its own driver. Examples of drivers 50 are shown as D1, D2 in FIG. 2. At power up, power is applied by the respective drivers to each lamp in a "stair step" fashion; that is, at first a relatively low level of power is applied to the lamp, and this step level is maintained until the lamp is at a thermal equilibrium. After equilibrium is reached, a slightly higher power is quickly supplied to the lamp until once again a thermal equilibrium is reached, the process repeating until full power is reached. In a practical embodiment, this power up cycle, from a cold start to full power suitable for fusing images, typically takes a few seconds. The time delay between "steps," that is, between incremental increases or decreases in power, can be controlled by either a fixed routine or using some sort of feedback system. In general, the more tungsten in the lamp, the longer time is spent at each step level. Also, in a running condition, overheating detection at any point in operation will be typically answered with a slight temporary decrease in power applied to each lamp, this decrease generally being consistent with the "top step" in the power up cycle. Also, at power down, the power applied each lamp can be similarly decreased in a stair step fashion.

Figure 4:
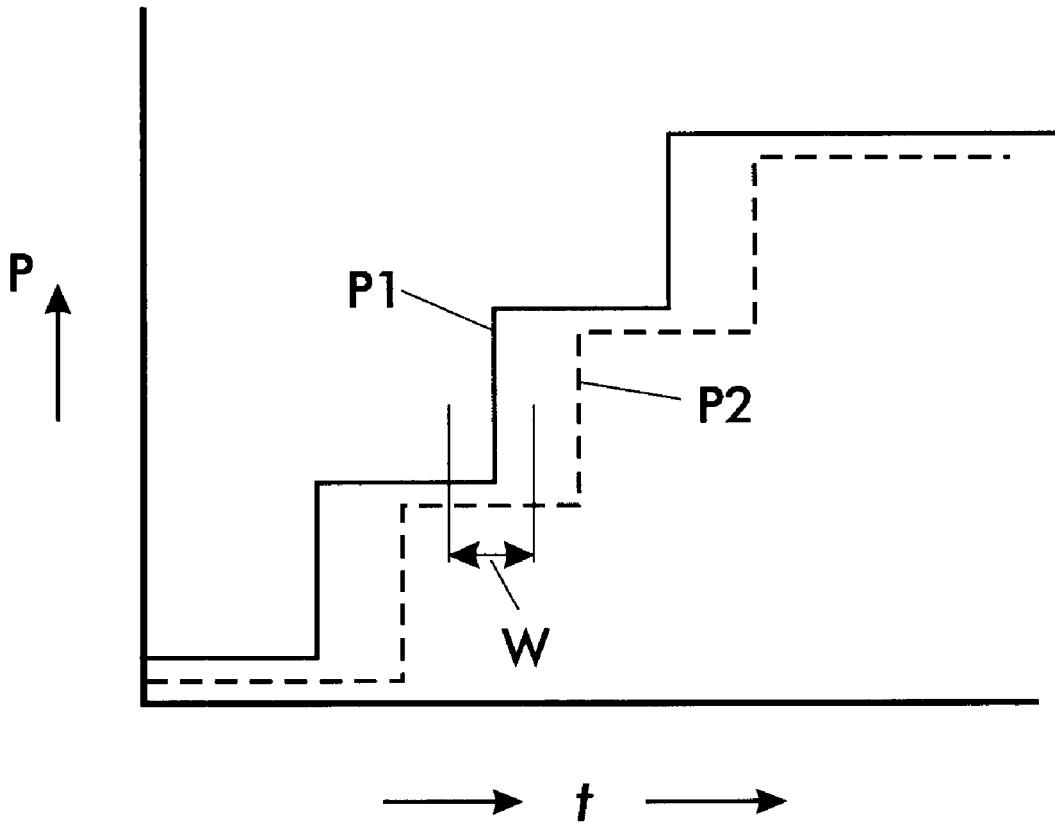
FIG. 4 is a diagram of a preferred method of changing the power applied to the lamps in the present invention.

According to a preferred embodiment, each lamp 20, 22 is independently powered in this stair step manner. Significantly, the software controlling power to each lamp is coordinated so that an increment or decrement in power to one lamp occurs only outside of a time window relative to a change in power to the other lamp. In other words, at power up, incremental increases in power to the lamps should occur out of phase. A diagram illustrating this out-of-phase stair step technique for power up is shown in FIG. 4: with P1 corresponding to the power to a first lamp and P2 corresponding to power to a second lamp over time t, it can be seen that any change (increase or decrease) in P2 must occur outside a time window of predetermined duration to a change in P1, yielding the desired "out-of-phase" effect. In another sense, it can be considered that for every change in P1, there should be provided a time-window W in which a change in P2 is not permitted. It has been found that this technique, particularly in conjunction with a fuser of the above-described configuration, is highly effective in reducing or eliminating the occurrence of flicker.

Another aspect of the present invention which is particularly useful in minimizing flicker is to configure, temporarily, the two lamps 20, 22 in series for the duration of power up, when power to the lamps 20, 22 is being increased, and then reconfigure the supporting circuitry so that the lamps are connected in parallel (or driven independently of each other) for a running condition where the apparatus is at substantially full power. For purposes of illustration, switch 52 in FIG. 2 is shown as being able to "short" the respective lines from the drivers D1, D2, in effect causing the lamps 20, 22 to be connected in series, but of course more sophisticated manifestations of the general principle will be used in a practical embodiment. This temporary series operation when starting from a "cold" condition creates a high initial resistance for the whole fusing apparatus, and therefore reduces the inrush current, which is a typical cause of flicker.

What is claimed is:

1. A fusing apparatus for use in xerographic printing, comprising:

a first heating element and a second heating element, each of the first heating element and the second heating element having a relatively hot portion and a relatively cold portion;

the relatively hot portion of each heating element being defined by a major portion of heat-producing material, the major portion of heat-producing material extending for greater than one-half of a main length of the heating element;

the first heating element and the second heating element being arranged whereby the relatively hot portion of the first heating element is adjacent the relatively cold portion of the second heating element; and the major portion of heat-producing material in the first heating element partially overlapping the major portion of heat-producing material in the second heating element along the main lengths of the heating elements.

2. The apparatus of claim 1, the first heating element and the second heating element each defining a main length thereof, and disposed so that the main length is substantially perpendicular to a process direction of a substrate passing through the fusing apparatus.

3. The apparatus of claim 1, further comprising a fuser roll, and the first heating element and the second heating element being arranged inside the fuser roll.

4. The apparatus of claim 1, wherein, for at least one heating element, the relatively hot portion has a higher distribution of heat-producing material than the relatively cold portion.

5. The apparatus of claim 1, wherein the first heating element and the second heating element have substantially identical configurations of heat producing material.

6. The apparatus of claim 1, each heating element including a major portion of heat-producing material disposed toward one end of the heating element, and at least one smaller portion of heat-producing material.

7. The apparatus of claim 6, the major portion of heat-producing material and the at least one smaller portion of heat-producing material being connected in series.

8. The apparatus of claim 1, further comprising means for selectably energizing the first heating element and not the second heating element.

* * * * *